United States Patent [19]

Hosoki et al.

[11] 4,143,292

[45] Mar. 6, 1979

[54] FIELD EMISSION CATHODE OF GLASSY CARBON AND METHOD OF PREPARATION

[75] Inventors: Shigeyuki Hosoki, Hachioji; Hiroshi Okano, Tokyo, both of Japan

[73] Assignee: Hitachi, Ltd., Japan

[21] Appl. No.: 700,024

[22] Filed: Jun. 25, 1976

[30] Foreign Application Priority Data

| | | | |
|---|---|---|---|
| Jun. 27, 1975 | [JP] | Japan | 50-79403 |
| Mar. 24, 1976 | [JP] | Japan | 51-31248 |
| Apr. 2, 1976 | [JP] | Japan | 51-36033 |

[51] Int. Cl.[2] ..... H01J 1/16; H01J 19/10

[52] U.S. Cl. ..... 313/336; 29/25.18; 252/502; 313/346 R

[58] Field of Search ..... 313/336, 346, 357; 252/502; 29/25.17, 25.18

[56] References Cited

U.S. PATENT DOCUMENTS

| | | | |
|---|---|---|---|
| 1,628,045 | 5/1927 | Hendry | 313/336 X |
| 3,109,712 | 11/1963 | Redfern | 252/502 |
| 3,728,570 | 4/1973 | Smith et al. | 313/336 |

FOREIGN PATENT DOCUMENTS

| | | | |
|---|---|---|---|
| 46-5639 | 1971 | Japan | 313/357 |

*Primary Examiner*—Saxfield Chatmon, Jr.
*Attorney, Agent, or Firm*—Craig & Antonelli

[57] ABSTRACT

A field emission cathode comprising a cathode base composed of carbon or a high-melting-point metal and a needle-shaped cathode composed of glassy carbon, which can provide a high field emission stably even under a high vacuum pressure, and a method for the preparation of this field emission cathode.

30 Claims, 22 Drawing Figures

FIELD EMISSION CATHODE OF GLASSY CARBON AND METHOD OF PREPARATION

BACKGROUND OF THE INVENTION

The present invention relates to a field emission cathode which is a high brightness electron source, and a method for the preparation thereof. More particularly, the invention relates to a field emission cathode which can provide a high field emission stably even under a high vacuum pressure, and a method for the preparation thereof.

The field emission cathode is a cathode which emits electrons by a tunnel effect when a high electric field is applied thereto. As is well-known in the art, in the field emission cathode, as the intensity of the electric field to be applied is increased, the obtained current density can be heightened, and a current density of about $10^5$ A/cm$^2$ can easily be obtained. This value of the current density is about $10^3$ times the practical upper limit of the current density obtainable by a so-called thermionic cathode, which is about 100 A/cm$^2$. Therefore, many research works have heretofore been made to apply this field emission cathode to various electron beam instruments such as electronic microscopes, electron probe microanalyzers and electron beam fabrication instruments, and at the present the field emission cathode is used for some electron beam instruments.

The practical application of this field emission cathode involves a serious problem. Namely, no good current stability can be obtained unless the cathode is actuated under ultra high vacuum of the order of $10^{-10}$ Torr. In this point, the field emission cathode is very disadvantageous over the thermionic cathode which is stably actuated under a higher vacuum pressure of about $10^{-5}$ to $10^{-6}$ Torr, and this disadvantage results in increase of costs for production of an evacuation system, a vacuum instrument and the like and treatment costs.

It is known that the current density of the field emission cathode is improved as a high vacuum, i.e. a low pressure, but the reason why the stability is lowered at a low vacuum or high pressure has not been completely elucidated. Of course, it is presumed that the reduction of the stability may be caused by adsorption of residual gases at the cathode tip surface, ion bombardment to the cathode tip owing to ions which are ionized by electrons from neutral gases and migration of admolecules and adatoms, and such presumption is supported to some extent by experimental facts. However, a complete system has not yet been established for the mechanism of the above reduction of the current stability. Accordingly, although various research works have heretofore been made on the clean surface of tungsten (W) which is only one substance now practically utilized as the field emission cathode, the unstability of field emission has not been revealed.

When tungsten is actuated as a field emission cathode under ultra high vacuum of $5 \times 10^{-9}$ to $5 \times 10^{-10}$ Torr under such condition that extreme discharge of gases is not caused on the anode by radiation of currents, it is noted that some problems arise.

In the first place, drastic current damping is caused in the initial emission. It is understood that this is due to adsorption of molecules of hydrogen which is a major residual gas component left in a high vacuum instrument even after evacuation by an ion pump.

In the second place, the so-called stable region is changed greatly depending on the vacuum pressure and the electron bombardment at the anode, and a minute difference of the operation condition or the effective evacuating volume between the cathode and the anode results in a great difference of the current in the stable region or the term of the stable region. When the vacuum pressure is elevated, the term of the stable region is especially shortened.

In the third place, in general, the radiative angle $\beta$ of the field emission from a needle-shaped cathode of tungsten is as large as ½ rad, and the field emission pattern on the anode screen differs greatly depending on the direction of the crystallographical surface of the needle portion. In general, the aperture angle $\alpha$ of the small anode slit is changed according to the use of the electron probe after passage through the anode depending on the desired current density, probe size and probe current, but it is usually less than 15 mrad. Accordingly, the fact that the radiative angle $\beta$ of the field emission is as large as ½ rad means that a total emission current about 1000 times the probe current is required. The magnitude of the fluctuation of the probe current as a local current is much higher than that of the total emission current especially when the vacuum pressure is high. Even if the noise component (the magnitude of the local current fluctuation) is reduced within 5%, the term of the stable region is several hours at longest.

As will be apparent from the foregoing illustration, some difficulties are involved in taking out a current from tungsten by field emission stably for a long time even under the condition of ultra high vacuum. This is also true of metals other than tungsten, alloys and compounds more or less.

However, demand for using a high current density electron source under a higher vacuum pressure is great, and if this demand is satisfied, various effects and advantages will be attained. For example, when a needle-shaped cathode of tungsten is used under vacuum of $1 \times 10^{-7}$ Torr, the proportion of the noise component is increased to about 100% (fluctuation equal to the measured current value) in a very short time and the needle-shaped cathode will be destroyed by discharge one to several minutes. As means for improving the stability under the condition of a higher vacuum pressure, there may be considered heating of a needle-shaped cathode. More specifically, according to this solution, admolecules are not allowed to stick on the surface of the cathode or the residence time is shortened. In short, the essence of this solution is to determine the sticking probability at a certain temperature, and some effects can be obtained according to this solution (although the effects are very low under $1 \times 10^{-7}$ Torr, considerable effects can be obtained under a vacuum pressure of the order of $10^{-9}$ Torr). As one phenomenon seen in the field emission, there can be mentioned one in which a high field intensity is present at the tip of the needle-shaped cathode and hence, a high attractive force is imposed on the cathode tip. What resists this attractive force is the tensile strength of the cathode material. This strength is reduced by heating. Accordingly, if a needle-shaped cathode of tungsten is used under a higher vacuum pressure without heating, the cathode is destroyed by adsorption of gases, ion bombardment and finally vacuum arc discharge, and if heating is conducted, the tip of the cathode is deformed by the attractive force of the electric field and the vacuum arc discharge is caused by mechanical destruction.

Because of these two destruction processes, no effective solution for stabilizing the field emission under a higher vacuum pressure has been provided.

As pointed out above, the cause of the current fluctuation (noise) in a field emission cathode has not been elucidated, but the number of factors considered to cause this undesired phenomenon is limited. Accordingly, investigations have been made to reduce influences of these factors.

(1) Gas Adsorption:

Apparently, there is a certain relation between the vacuum pressure and the noise in the field emission, though the mechanism has not been clarified. It is generally explained that the work function of the cathode surface is minutely changed by adsorption of gases and this minute change of the work function causes the current fluctuation. However, the effects by adsorption, desorption and migration on the cathode surface must be detailed. In case of a single crystal such as tungsten, the work function differs among respective crystallographical surfaces, and hence, also the sticking probability and the sticking energy differ. As regards adsorbed gases, it is known that adsorbed hydrogen molecules ($H_2$) are effective for stabilizing the current but adsorbed carbon monoxide molecules (CO) enhance the current unstability.

In order to reduce the influence of gas adsorption, it is preferred to use a cathode in which the change of the work function by gas adsorption is very small, the adsorption is stronger and stable, or the adsorption is substantially reduced by heating without reduction of the tensile strength.

(2) Work Function of Cathode:

In general, a higher work function is preferred because a lower work function is more readily influenced by gas adsorption, and it is also preferred that the difference of the work function among crystallographical surfaces be small, because a smaller difference is more effective for reducing the effects by migration. It is preferred to use a substance having no crystal structure if possible.

(3) Ion Etching Rate:

In view of consumption or destruction of the cathode by ion bombardment, it is preferred that the ion etching rate (the ratio of the number of ions etched on a unit area for a unit time to the total number of ions) be low.

(4) Strength to Discharge:

In order to enable field emission under a high vacuum pressure, first of all, it is necessary that the tip of the cathode should not readily be destroyed by discharge. In case of tungsten, the cathode tip is substantially completely destroyed by discharge under a high vacuum pressure and the tip is rounded. This means that tungsten is locally molten and evaporated by vacuum arc discharge. Accordingly, a substance having a very high melting point or a substance that does not melt at all meets this requirement.

A substance fully satisfying all of the above 4 requirements completely is not present at all. It is as if conductive diamond were sought for. Carbon materials have a work function of 4 to 4.5 eV and they have inevitably a low ion etching rate and do not melt under an atmospheric pressure on the earth. Accordingly, they are considerably satisfactory except the point (1). In connection with this point (1), in view of the value of the electron negativity of carbon materials (higher than that of tungsten and not so different from those of adsorbed gases), it is presumed that the influence by adsorbed gases is smaller in carbon materials, though the work function is substantially equal to that of tungsten.

The foregoing considerations are well in agreement with experimental data reported by T. H. English et al ("Scanning Electron Microscopy; System and Applications, 1973", pages 12–14. Conference Series No. 18, The Institute of Physics, London and Briston). Namely, it is reported that when a carbon fiber is used as a carbon material for a field emission cathode, a vacuum pressure of the order of $10^{-8}$ Torr is sufficient for obtaining a current stability comparable to the current stability of tungsten.

As will be apparent from the above experimental results, it is very difficult to obtain a single spot when a carbon fiber is used, and there is a disadvantage that in order to obtain a stable single point, a maximum emission current must be maintained at such a low level as several $\mu$A. As pointed out by Braum et al (Vacuum, 25, No. 9/10, 1975, pages 425–426), the reason is construed to be that the carbon fiber is composed of finer fibrils. The carbon fiber has a structure in which fine fibrils are bundled along the fiber axis. Accordingly, even if a needle-shaped cathode is formed from the carbon fiber, a smooth cathode tip surface is not obtained and field emission takes place on each of tips of respective fibrils.

Further, in case of a carbon fiber cathode, since the tip surface is not smooth, the tensile strength is insufficient and the resistance to discharge is low. This specific structure of the carbon fiber is deemed to be due to the fact that since the carbon fiber is prepared by calcining at a high temperature and carbonizing a rayon or acrylic fiber, the carbon fiber has the regularity as seen in graphite along the fiber axis in interiors of fibrils.

SUMMARY OF THE INVENTION:

It is a primary object of the present invention to provide a novel field emission cathode which can operate stably for a long time under the condition of ultra high vacuum and can also operate stably for a long time even under a vacuum pressure of the order of $10^{-7}$ Torr.

Another object of the present invention is to provide a method for the preparation of such novel field emission cathode.

Still another object of the present invention is to provide a carbon material effective as a field emission cathode having the above characteristics.

According to the present invention, these and other objects are attained by a field emission cathode comprising a cathode base and a needle-shaped cathode composed of glassy carbon. Carbon or a high-melting-point metal is suitable as the cathode base.

In accordance with another aspect of the present invention, three is comprehended a method for the preparation of a field emission cathode comprising the steps of shaping a glassy carbon raw material into a needle and curing the shaped glassy carbon raw material, calcining the shaped glassy carbon raw material at a high temperature in vacuo or in an inert gas atmosphere to carbonize the glassy carbon raw material and convert it to glassy carbon, and etching the tip of the resulting needle-shaped glassy carbon.

The above and other objects and features of the present invention will be apparent from the following detailed description and the accompanying drawings.

Figure 1A:
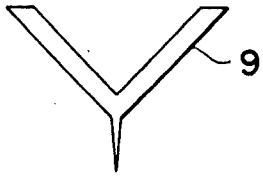
FIGS. 1, 6 and 7 are diagrams illustrating embodiments of the present invention.
Figure 1B:
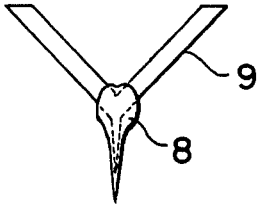
Figure 1C:
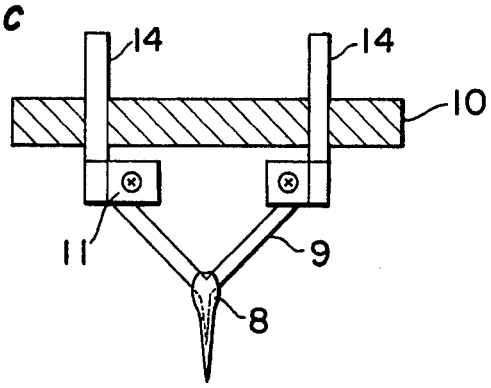
Figure 1D:
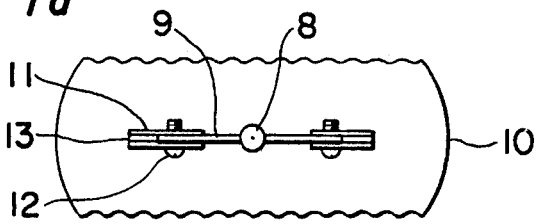

DETAILED DESCRIPTION OF THE PREFERRED EMBODIMENTS:

As is well-known in the art, the carbon material include various forms. Among them, graphite, carbon black, pyrolitic graphite, glassy carbon and carbon fiber are famous.

The carbon material has properties advantageous for a field emission cathode, such as high electron negativity, low ion etching rate and incapability of melting at high temperatures. However, when a practical field emission cathode is prepared from the carbon material, the following points must be taken into consideration.

As is well-known in the art, the equivalent radius of the cathode tip is generally adjusted to about 1000 Å so as to use a take-out voltage of a small absolute value and attain a high field magnitude. Accordingly, it is necessary that the carbon material to be used as the cathode should have a compact structure, namely a low porosity, and have a good processability, namely a good adaptability to etching. It is also necessary that the cathode tip surface after the etching treatment should be smooth and the field emission pattern should depend only on the geometric configuration of the cathode tip.

If these requirements are satisfied, such glassy carbon is satisfactory in all the points as the field emission cathode. From old it has been known that glassy carbon is a typical instance of impermeable carbon, and the gas permeability of glassy carbon is about $10^{-10}$ of that of graphite. Thus, it will readily be understood that glassy carbon has a very compact structure and it can be etched very easily. Further, as is apparent from the name, the surface of glassy carbon is very smooth, and it is amorphous.

These characteristics of glassy carbon are owing to the specific carbon structure. As regards the interior carbon linkage structure of glassy carbon, it has been clarified that tetrahedral single linkages, plane double linkages and linear triple linkages are present in the mixed state and as a whole a three-dimensional irregular net-like structure (so-called tangle structure) is formed. This is described in, for example, G. M. Jenkins et al, Nature, 231, May 21, 1971, pages 175–176.

Various processes for the preperation of glassy carbon have heretofore been proposed in, for example, Japanese Patent Publication No. 20061/64, Japanese Patent Publication No. 40524/71, Japanese Patent Application Laid-Open Specification No. 109286/74 and the above G. M. Jenkins et al reference.

The typical process comprises curing a thermosetting resin such as a furan resin (fulfuryl or pyrrole type), a phenolic resin or a vinyl resin derived from divinyl benzene, which is used as a glassy carbon raw material, and hardening the cured resin at a high temperature in vacuo or in an inert gas atmosphere to carbonize the resin.

More specifically, furfuryl alcohol

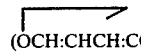

having a water content lower than 1% and a furfural content lower than 1% is charged as a starting thermosetting resinous material into a beaker, 0.8% of ethyl p-toluenesulfonate ($CH_3C_6H_4SO_3C_2H_5$) is added as a catalyst, the mixture in the beaker is heated in a thermostat tank maintained at 70° to 90° C. for about 2 hours under agitation with a glass rod to form a slightly viscous semi-polymer, and the semi-polymer is thermally set in a thermostat tank maintained at 90° C. Then, the cured product is hardened at a high temperature in vacuo or in an inert gas atmosphere to remove elements other than carbon by gasification and carbonize the cured product, whereby glassy carbon is obtained.

Two methods can be considered for preparing a needle-shaped cathode from glassy carbon prepared according to the above process, one method comprising forming a cathode after preparation of glassy carbon and the other method comprising shaping a cathode during the steps of forming glassy carbon from the raw material. According to the former method, glassy carbon having a thickness of, for example, 0.1 to 0.2 mm is prepared and a cathode structure (including a cathode base) is formed from this glassy carbon by discharge processing or the like. According to the latter method, a slightly viscous semi-polymer prepared during the above process for preparing glassy carbon, is shaped into a needle form and the shaped semi-polymer is then cured and carbonized. A cathode can be prepared more simply according to the latter method.

FIG. 1 illustrates one embodiment of the field emission cathode of the present invention, which is used for an electron beam instrument or the like.

Referring now to FIG. 1-A, a cathode base 9 is a carbon sheet having a thickness of 0.1 to 0.2 mm (any conductive carbon can be used as the cathode base and conductive carbon having a specific resistance of the order of about $10^{-3}$ Ω-cm is most preferred), which has been shaped into a hair pin-like form having a projection at the bent part.

FIG. 1-B shows a cathode. A glassy carbon raw material, for example, a semi-polymer of a thermosetting resin as described above is coated on the cathode base 9 in the vicinity of the projection, and the tip of the projection is processed to have a diameter of about 0.1 mm and the coated base is heated at about 90° C. to effect thermosetting. Then, the coated cathode base is gradually heated in, for example, a vacuum furnace. At about 800° C. degasification is conspicuous. Accordingly, heating is conducted carefully so that cracks are not formed. Finally, a heat treatment is carried out at about 1000° to about 2500° C. to effect degasification sufficiently. Thus, a needle-shaped cathode 8 is formed. As regards the heating rate, it is preferred that the heating be conducted in vacuo or in an inert gas atmosphere at a temperature-elevating rate of 1° to 6° C./min. until the temperature reaches about 350° to about 400° C. and in vacuo or in an inert gas atmosphere at a temperature-elevating rate of 10° to 30° C. until the temperature reaches about 1500° C. If the temperature is elevated beyond 1500° C., a higher temperature-elevating rate may be adopted. These heating rates are preferred conditions for obtaining a needle-shaped cathode having good quality, and a needle-shaped cathode can be prepared by adopting other heating rates.

Further, at the heating step, heating may be accomplished by direct heating in vacuo instead of use of a vacuum furnace.

Referring now to FIGS. 1-C and 1-D illustrating an embodiment of the method for attaching the cathode to an insulator, the cathode base 9 is attached to a supporting member 11 welded to a stem 14 fixed to a glass base 10. The supporting member 11 is composed of tungsten, tantalum, molybdenum, stainless steel or the like. A spacer 13 and a screw 12 are composed of a similar material.

The most important role of the cathode base 9 is the role as a resistant heating element when the field emission cathode is flashed or used under heating, and the cathode base 9 also acts as a member supporting the cathode on the supporting member 11. As pointed out hereinbefore, carbon or a high-melting-point is suitable as the cathode base 9, and as the high-melting-point metal, there are preferably employed transition metals having a resistance to high temperatures, such as tungsten, tantalum, rhenium, titanium and zirconium. As carbon, there is employed, for example, a plate of sintered carbon after polishing. In addition, a plate of graphite or glassy carbon may be used.

One characteristic feature of the cathode of the present embodiment is that since the thermal expansion coefficient is not so different between the cathode base 9 and the needle-shaped cathode 8, peeling or isolation of the needle-shaped cathode 8 from the cathode base 9 is effectively prevented and a good durability can be attained.

Figure 2:
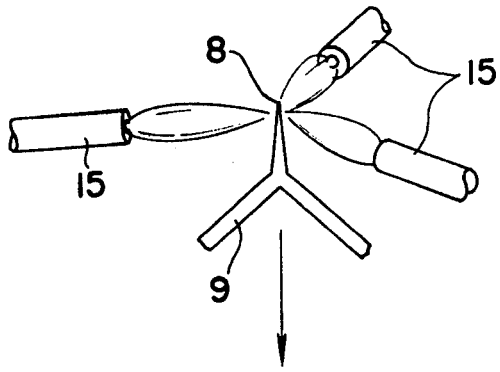
FIG. 2 is a diagram illustrating the preparation method of the present invention.

In preparing the intended cathode, it is necessary that the tip of the needle-shaped cathode 8 should be etched so that it has an equivalent radius of about 1000 to about 3000 Å. A flame etching method, which is most effective among etching methods, is illustrated in FIG. 2. Reference numeral 15 indicates a burner of ordinary service gas or oxygen-hydrogen gas. The burner is prepared and adjusted so that the flame from the burner is focussed as much as possible. The needle-shaped cathode 8 is set at the center of the flame so that the temperature of the needle-shaped cathode 8 is elevated to 500° to 800° C. and the cathode 8 is moved to the direction of an arrow. By this treatment, carbon is oxidized (burnt) to carbon dioxide gas to thereby effect etching. By this operation, the tip of the glassy carbon needle-shaped cathode 8 is made to have an equivalent radius of 1000 to 3,000 Å. The number of the burner 15 is not limited to 3 as shown in FIG. 2, and a sufficient etching effect can be obtained even when one burner 15 is used. In this case, similar effects can be obtained when the needle-shaped cathode 8 is rotated around the axis of the tip.

Characteristics of the field emission cathode prepared according to the above-mentioned method will now be described.

Figure 3:
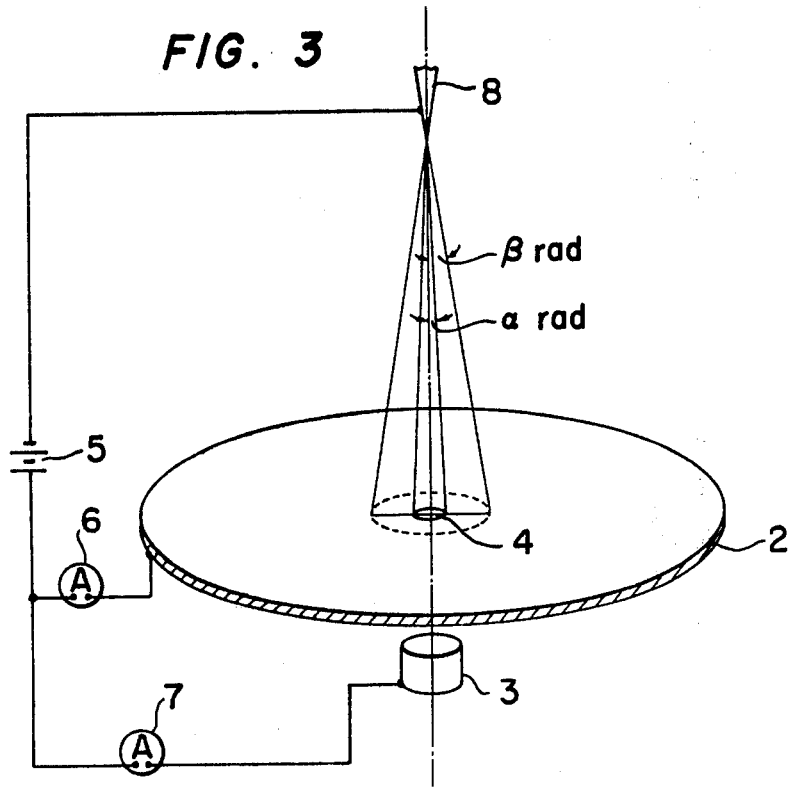
FIG. 3 is a diagram illustrating an apparatus for measuring characteristics of the cathode of the present invention.

FIG. 3 is a diagram illustrating an apparatus for measuring the characteristics of the field emission cathode. Reference numerals 8, 2, 5, 4 and 3 denote a glassy carbon needle-shaped cathode, a phosphor-coated anode, a power source for applying an electric voltage necessary for field emission, a slit having an aperture angle $\alpha$ (rad) and a Faraday cup for collecting electrons passing through the slit 3, respectively. Reference numerals 6 and 7 denote an ampere meter for measuring the current and a recorder. When the equivalent radius of the tip of the needle-shaped cathode is about 1000 Å, the total current of 1 to 100 $\mu$A is measured under a voltage of 3 to 4 KV. The field emission pattern appearing on the anode is not particularly regular and only a slight light-dense fluorescent pattern is observed. Namely, a substantially round pattern indicated by a dot line in FIG. 2 is observed. In case of tungsten, as pointed out hereinbefore, the local current passing through a slit of an aperture angle $\alpha$ of 15 mrad is about 1/1000 of the total current, whereas in case of glassy carbon, under substantially same conditions, the aperture-passing local current is 1/20 to 1/100 of the total current. In other words, in case of glassy carbon, the aperture angle $\beta$ of the total current is in the range of from 0.07 to 0.14 rad. This feature is owing to the fact that the glassy carbon needle-shaped cathode has no crystal structure, and the emission pattern depends entirely on the geometric shape of the tip and the applied field.

Also the above-mentioned range of the aperture angle, strictly speaking, depends on the shape of the needle tip.

Figure 4A:
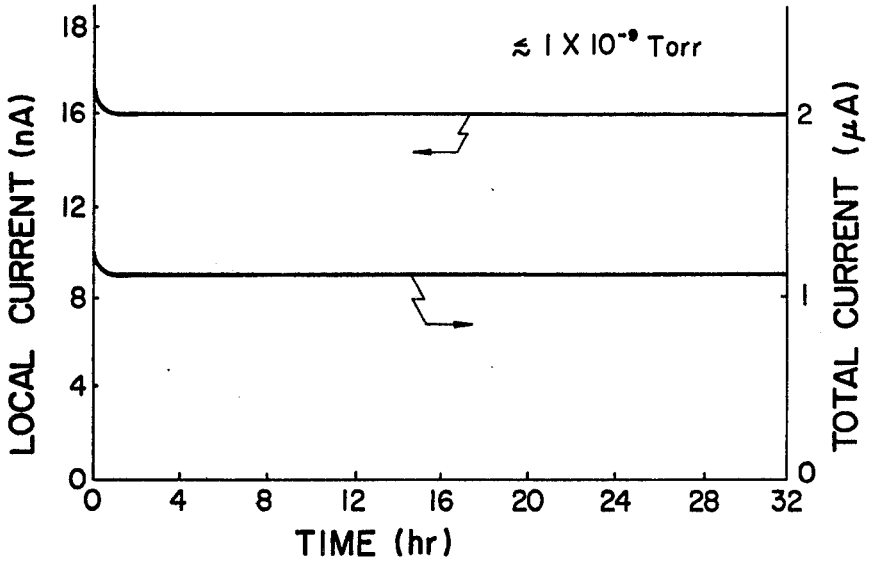
FIGS. 4, 5, 9 and 10 are diagrams illustrating characteristics of the cathode of the present invention.
Figure 4B:
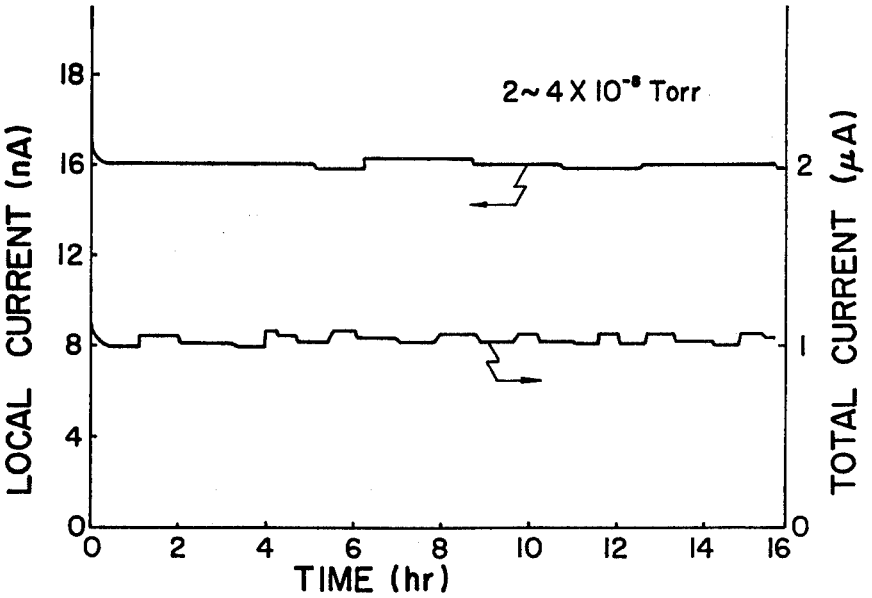

In the field emission cathode of the present invention, as shown in FIG. 4-A, the fluctuation of the emission current over a period of more than 30 hours is lower than 1% under a vacuum pressure lower than $1 \times 10^{-9}$ Torr, and the fluctuation is substantially constant. Further, the initial damping is about 10% of the current value in case of either the total current or the local current, and as in case of tungsten, the initial damping is deemed to be mainly due to adsorption of hydrogen. It is seen that as presumed hereinbefore, the small damping indicates a much reduced influence of adsorbed gases on the work function.

Any of data of experiments made on tungsten needle-shaped cathodes by using the same experimental apparatus cannot surpass this very high stability that is maintained for a long time. In the experiment where an anode plate having a clean surface is used instead of a phosphor anode generating large quantities of outgases, a high stability similar to that shown in FIG. 4-A is obtained when the total current is up to 100 $\mu$A and the local current is up to about 1 $\mu$A. When a fluctuation of up to about 5% is allowed, a total current of up to 1 mA can be taken out. When the experiment is conducted while elevating the vacuum pressure by controlling the evacuation rate of an ion pump by a throttle valve, as is shown in FIG. 4-B, the fluctuation of the total current is increased to some extent under $2 \times 10^{-8}$ Torr but under this vacuum pressure, the fluctuation of the local current takes place at an interval of the order of hours. Thus, it is confirmed that the current fluctuation is within such a narrow range as will not cause any practical disadvantage. As will be apparent from FIG. 4-B, fluctuations of the two currents in the glassy carbon cathode are more stepwise and of much lower frequencies than in the tungsten cathode, and they cannot be regarded as noise components. This is one of characteristic features of the glassy carbon cathode of the present invention.

Figure 5A:
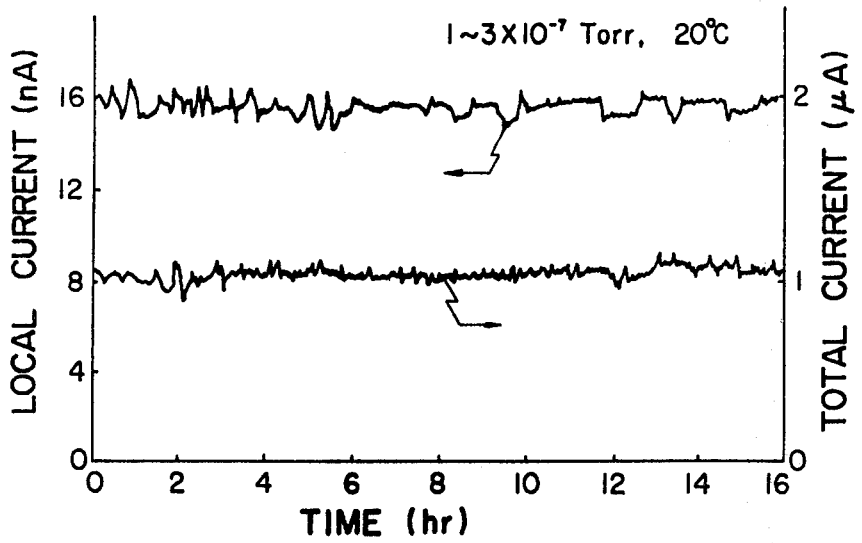
Figure 5B:
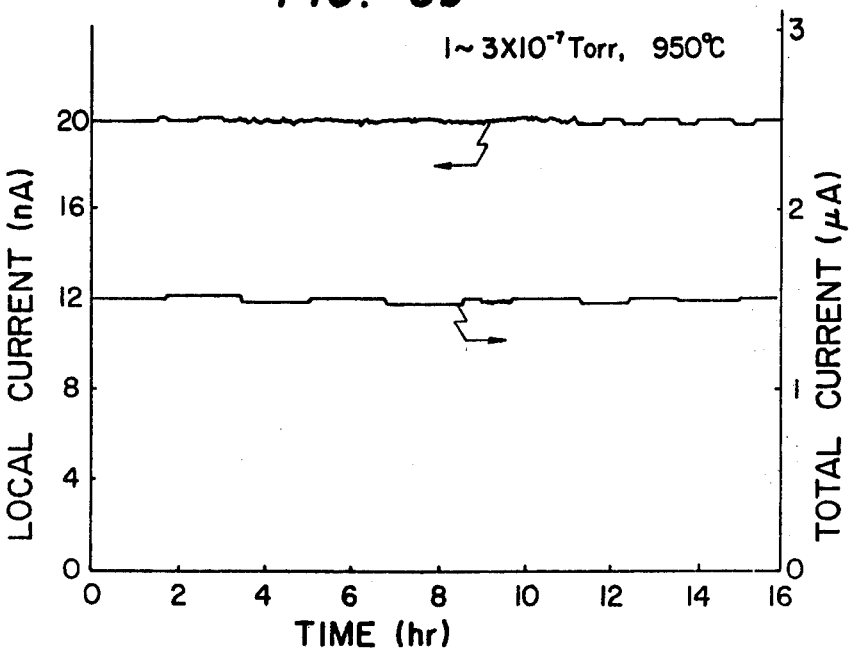

FIG. 5 shows results obtained when the vacuum pressure is elevated to $1 \times 10^{-7}$ to $3 \times 10^{-7}$. From FIG. 5-A showing results obtained at room temperature (20° C.), it is seen that in addition to stepwise fluctuations, noises of a high frequency appear in the total current and the local current fluctuation is as high as 15 to 20%.

Results of the experiment in which it is tried to reduce this influence by adsorption of gases by heating are shown in FIG. 5-B. When the cathode tip is heated at about 950° C., both the local current and the total current are more stabilized than in case of FIG. 5-A. Field emission that can be stabilized for such a long time under $1 \times 10^{-7}$ to $3 \times 10^{-7}$ Torr is epoch-making. Results shown in FIG. 5 are those obtained when no countermeasure is made to the anode surface against outgases generated by electron bombardment. When the anode surface is cleaned, a further improved stability can be obtained.

For example, when the anode surface is cleaned by vacuum deposition of other substance under heating in vacuo, a current of 100 $\mu$A can be obtained at such a high stability as corresponding to a current fluctuation of about 5% even under a vacuum pressure of $10^{-7}$ Torr and even a current of 1 mA can be obtained at a stability corresponding to a current fluctuation of 10%.

Figure 6A:
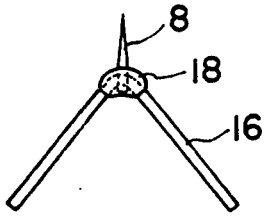
Figure 6B:
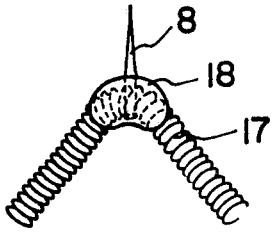

Another embodiment of the present invention is illustrated in FIG. 6. As pointed out hereinbefore, it is preferred that the cathode base be composed of a material having a thermal expansion coefficient equivalent to that of glassy carbon. In some case, the cathode base can be prepared very simply from a metal. FIG. 6-A shows a cathode prepared by bonding a needle-shaped cathode 8 of glassy carbon which has been in advance shaped in a form of a small cone and heat-treated, to a hair pin-like cathode base 16 composed of a high-melting-point metal such as tungsten or tantalum with a semipolymer 18 of a thermosetting resin, heating the bonded assembly at 90° C. to cure the semi-polymer and calcining it at a high temperature to convert the semi-polymer to glassy carbon and bond the cathode 8 to the base 16, whereby conductivity is imparted to the cathode.

In this case, since the thermal expansion coefficient of the metal is considerably different from that of glassy carbon, it is necessary to effect both the heating and the cooling very gradually at the heat treatment.

FIG. 6-B illustrates an embodiment where a structure allowing a considerable difference of the thermal expansion coefficient between the metal and glassy carbon is adopted. A metal 17 such as tantalum or tungsten is formed in a coil having an outer diameter of about 1 mm, which is composed of a metal wire of a diameter of 0.1 mm, and this metal coil 17 is used as the hair pin-like cathode base and by using this cathode base, a cathode is prepared in the same manner as described above with respect to FIG. 6-A. Attachment of glassy carbon to the metal cathode base is accomplished most effectively according to this method.

Still another embodiment of the present invention is illustrated in FIG. 7. This embodiment is characterized in that the cathode base has a linear shape such as a rod-like shape or a strip-like shape. This cathode base has a high mechanical strength and a high resistance to a destructive force such as thermal stress or fatigue. Further, the cathode base of this type can be prepared very easily.

FIG. 7-A is a sectional view showing this embodiment. A strip-like carbon sheet 9 has a central projection 9' and a glassy carbon needle-shaped cathode 8 is formed to coat the central projection 9' of the carbon sheet 9. The tip of the cathode 8 is etched. FIG. 7-B is a sectional view of another embodiment, which is more simplified than the embodiment of FIG. 7-A. In this embodiment, a carbon sheet 9 is merely shaped into a strip-like form and a projection of glassy carbon is formed at the center thereof. The tip of the projection is etched as in the embodiment of FIG. 7-A. In an embodiment shown in FIG. 7-C, a needle-shaped cathode 8 of glassy carbon which has been formed into a rod or fiber in advance is bonded to one side face of a strip-like carbon sheet 9 as used in the embodiment of FIG. 7-B with a semi-polymer 18 of the same thermosetting resin as used as the raw material of glassy carbon in the foregoing embodiments. Then, the semi-polymer is cured and carbonized at a high temperature in vacuo or in an inert gas atmosphere to convert it to glassy carbon. FIG. 7-C is a side view showing the so formed cathode.

Figure 8:
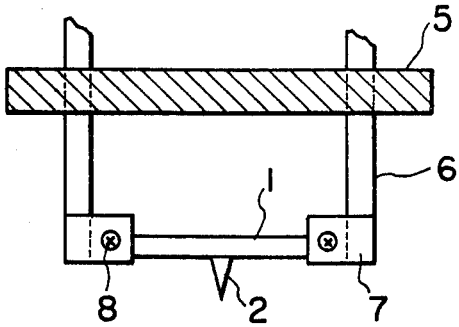
FIG. 8 is a diagram illustrating a method for attaching the cathode of the present invention.
Figure 9A:
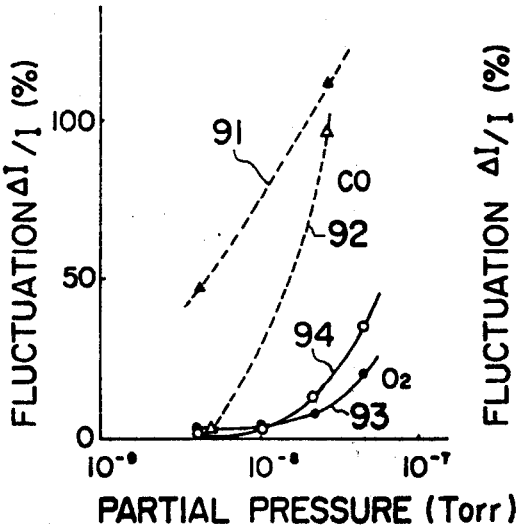
Figure 9B:
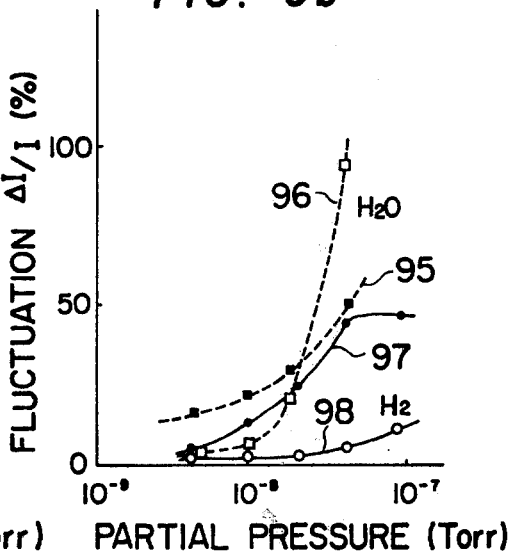
Figure 9C:
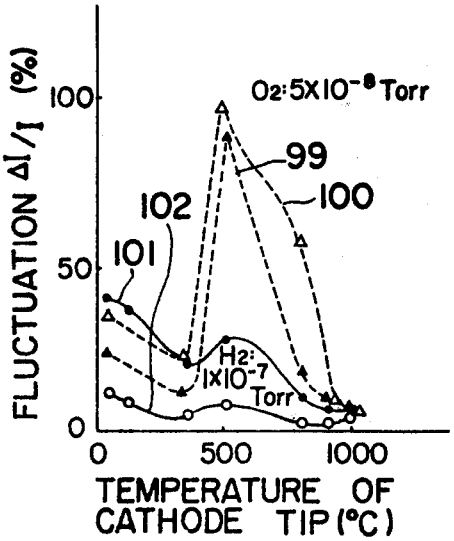
Figure 9D:
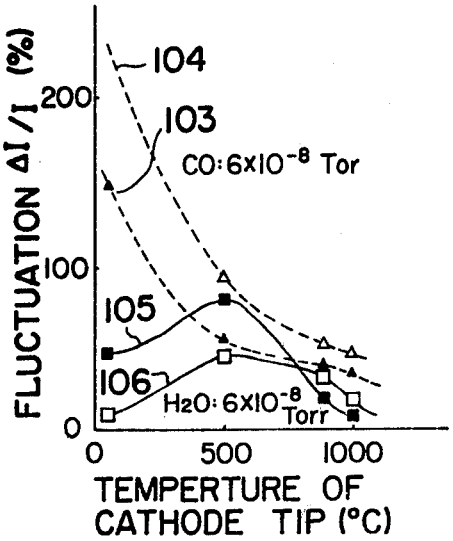

FIG. 8 is a diagram showing a method for supporting the cathode of the present invention. The cathode is fixed by a screw 12 to a supporting member 11 welded to the top end of a stem 14 attached to a glass base 10.

In view of the flashing power source (required power) and the mechanical structure, it is practically preferred that the strip-like carbon sheet has a width of 0.5 to 2 mm, a thickness of 0.1 to 0.3 mm and a length of 5 to 20 mm.

In addition, a straight carbon rod may be used. However, when a strip-like carbon sheet as shown in FIG. 7 is employed, attachment of the cathode to a supporting member 11 as shown in FIG. 8 can be performed very easily. Further, this strip-like carbon sheet can easily be prepared only by cutting a starting sheet into strips, and when it is heated by flashing or the like, heating conditions can easily be maintained within a prescribed range. Moreover, since the strip-like carbon sheet has a high mechanical strength, the width or thickness of the cathode base can be reduced. Accordingly, there is attained an advantage that the electric power necessay for heating by flashing or the like can be saved.

By the term "needle-shaped cathode" used in the illustration given hereinbefore is meant a cathode having a needle-shaped tip, and a cathode of a diameter of about 10 $\mu$ formed on a plate is of course included in the needle-shaped cathode. Namely, cathodes in which at least a region for emission of electrons is composed of glassy carbon are included in the needle-shaped cathode of the present invention.

As illustrated hereinbefore with respect to FIG. 5, when the cathode of the present invention is employed, field emission can be performed very stably by heating. Results of the measurement of the influence of constituent gases of a vacuum atmosphere on the current stability (the ratio of the current fluctuation $\Delta I$ to the emission current I, namely the ratio $\Delta I/I$) will now be described.

The vacuum instrument shown in FIG. 3 is evacuated to about $5 \times 10^{-10}$ Torr, and various gases having a very high purity are positively introduced into the vacuum instrument and the measurement is then carried out.

Main residual gases in the ultra high vacuum system are $H_2$, $H_2O$ and CO. $O_2$ is a gas having a high interactivity with carbon. Accordingly, experiments are made on these 4 gases. Results are as shown in FIG. 9. FIGS. 9-A and 9-B show results of the measurement of the current density conducted when the cathode temperature is room temperature under gas partial pressures indicated in the drawings. Solid symbols, such as the solid triangular and circular symbols, show the results obtained with respect to the total current and open symbols, such as the openn triangular and circular symbols, show the results obtained with respect to the local current. In FIG. 9-A, curves 91 and 92 show data of the fluctuations of the total current and the local current obtained when the constituent gas is CO, and curves 93 and 94 show data of the fluctuations of the total current and the local current obtained when the constituent gas is $O_2$. In FIG. 9-B, curves 95 and 96 show data of the fluctuations of the total current and the local current obtained when the constituent gas is $H_2O$, and curves 97 and 98 show data of the fluctuations of the total current and the local current obtained when the constituent gas is $H_2$.

From the foregoing results, it is seen that the influence of CO is greatest, though data may be changed to some extent if experimental procedures are changed.

The improvement of the current stability by heating will now be described by reference to FIGS. 9-C and 9-D. In FIG. 9-C, curves 99 and 100 show data of the fluctuations of the total current and the local current obtained when the partial pressure of $O_2$ as the constituent gas is $5 \times 10^{-8}$ Torr, and curves 101 and 102 show data of the fluctuations of the total current and the local current obtained when the partial pressure of $H_2$ as the constituent gas is $1 \times 10^{-7}$ Torr. In FIG. 9-D, curves 103 and 104 show data of the fluctuations of the total gas and the local gas obtained when the partial pressure of CO as the constituent gas is $6 \times 10^{-8}$ Torr, and curves 105 and 106 show data of the fluctuations of the total current and the local current obtained when the partial pressure of $H_2O$ as the constituent gas is $6 \times 10^{-8}$ Torr. In each case, as will be apparent from these results, the current stability is remarkably improved at a temperature higher than about 800° C. over the current stability at room temperature. Thus, the above illustration concerning the improvement of the current stability is confirmed by experimental data. Hereupon, it is added that atmospheres having gas partial pressures shown in FIGS. 9-A to 9-D are not equivalent to vacuum atmospheres usually obtained by evacuation and since a phosphor plate is used as an anode, the current stability is also influenced by outgases from the anode.

The interrelation of these gases to glassy carbon will now be examined. As pointed out hereinbefore, the state of adsorption of gases is considerably known in case of tungsten as well as other surface characteristics thereof. However, as regards the carbon material, data obtained under ultra high vacuum have hardly been published.

Figure 10:
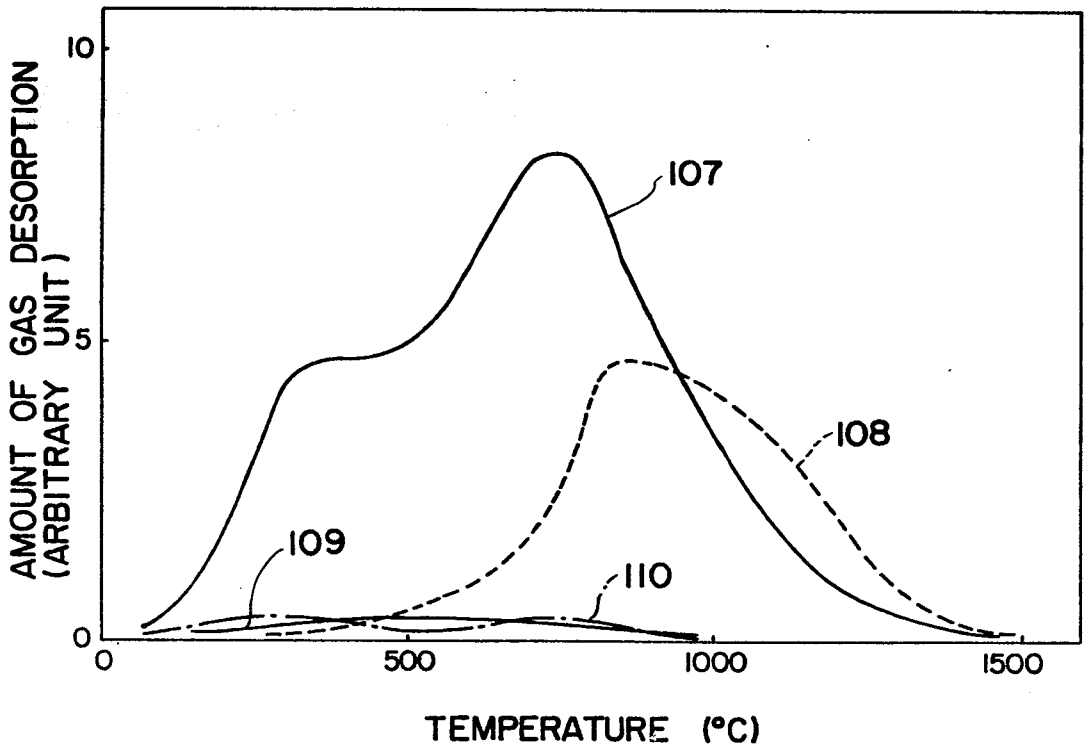

The simplest method for analysis of adsorbed gases is a so-called flash desorption method. The state of gas adsorption is examined according to this method. The outline of the experiment is as follows:

In a vacuum instrument in which ultra high vacuum can be attained, a sample of glassy carbon (3 mm in thickness) is arranged so that the sample can be heated by direct application of electricity. A mass analyzer for determining the kinds and quantities of desorbed gases is appropriately disposed, so that when glassy carbon is heated at a constant temperature-elevating rate by direct application of electricity, quantities of desorbed gases can be drawn as a spectrum. Results obtained are shown in FIG. 10. The vacuum instrument is evacuated to $2 \times 10^{-10}$ Torr and a high purity gas is then introduced thereinto. In the experiment, the gas partial pressure is adjusted to $1 \times 10^{-5}$ Torr and adsorption is conducted for 10 minutes. After stopping introduction of the gas, the instrument is evacuated again to ultra high vacuum ($1 \times 10^{-9}$ Torr), and the above-mentioned temperature-elevating desorption is then carried out. In such experiment, so-called chemical adsorption having a high sticking energy is generally observed and the degree of adsorption is deemed to correspond to monoatomic layer adsorption. As will be apparent from the results shown in FIG. 10, the state of adsorption differs greatly depending on the kind of the adsorbed gas though the adsorption is conducted under the same partial pressure for the same period of time. In FIG. 10, curve 107 shows results of the desorbed gas amount obtained when CO is desorbed after CO adsorption ($1 \times 10^{-5}$ Torr, 10 minutes), curve 108 shows results of the desorbed gas amount obtained when CO is desorbed after $O_2$ adsorption ($1 \times 10^{-5}$ Torr, 10 minutes), curve 109 shows results of the desorbed gas amount obtained when $O_2$ is desorbed after $O_2$ adsorption ($1 \times 10^{-5}$ Torr, 10 minutes), and curve 110 shows results of the desorbed gas amount obtained when $H_2$ is desorbed after $H_2$ adsorption ($1 \times 10^{-5}$ Torr, 10 minutes).

In case of $O_2$ adsorption → $O_2$ desorption or $H_2$ adsorption → $H_2$ desorption, the amount of the desorbed gas is less than one-tenth of the desorbed gas amount in case of CO adsorption → CO desorption, and no definite spectrum can be obtained because of the sensitivity of the mass analyzer. When $O_2$ gas is adsorbed and the amount of CO as the desorbed gas is measured, the amount of the desorbed gas is much larger than in case of $O_2$ adsorption → $O_2$ desorption. This means that when $O_2$ is adsorbed, it is desorbed substantially in the form of CO. The peak temperature in the temperature-elevating spectrum is about 750° C. in case of CO adsorption → CO desorption or about 810° C. in case of $O_2$ adsorption → CO desorption. The course of this difference cannot be directly discussed but it may be construed that in case of $O_2$ adsorption → CO desorption, adsorption is conducted according to one mode, whereas in case of CO adsorption → CO desorption, adsorption includes two modes.

Results of FIG. 10 fully support the presumption derived from results shown in FIGS. 9-A to 9-D, namely the presumption that the current stability will be improved by heating. More specifically, even in case of CO gas having a greatest influence on the current stability, the influence of the adsorbed gas can be reduced by heating the cathode at 700° to 750° C. or higher and the current stability can be remarkably improved. In these experiments, high purity gases are introduced to attain prescribed partial pressures. Hereupon, it is added that in actual vacuum atmospheres, the gas partial pressures are about $1 \times 10^{-7}$ Torr at highest, even if the total pressure is of the order of $10^{-7}$ Torr.

The foregoing results are those obtained by conducting experiments on field emission cathodes composed of glassy carbon. It is construed that similar results will be obtained in case of other field emission cathodes so far as they are composed of carbon element (C).

As will be apparent from the foregoing illustration, if the cathode of the present invention is used in the state heated at preferably at least 700° C., more preferably at least 750° C., a stable current can be obtained under a vacuum pressure higher than $10^{-7}$ Torr.

The uppr limit of the heating temperature is not particularly critical, but from the practical viewpoint, it is preferred that the heating temperature be not higher than 2000° C., because unnecessary degasification is caused at a temperature higher than 2000° C. by conductive heating of the cathode supporting member or radiation heating of the vacuum instrument.

Figure 11:
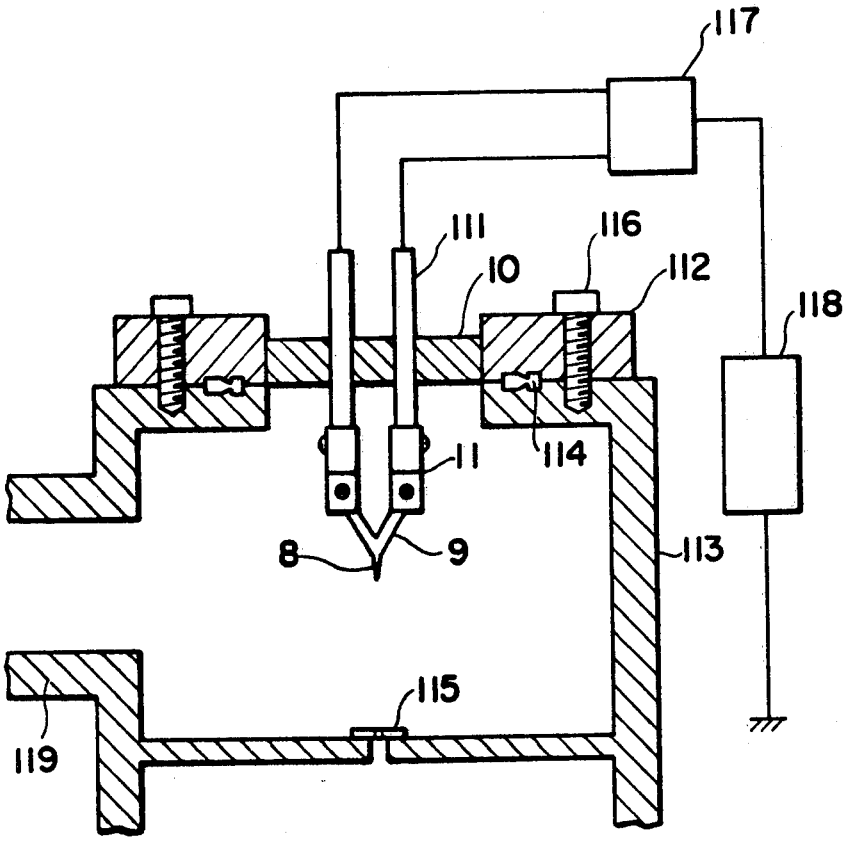
FIG. 11 is a diagram illustrating a field emission cathode provided with the cathode of the present invention.

An embodiment in which the cathode is heated as described above is illustrated in FIG. 11, wherein reference numerals 111, 112, 113, 114, 115, 116, 117, 118 and 119 denote an electrode, a vacuum flange, a vacuum instrument, a gasket, an anode slit, a bolt, a heating power source, a high voltage power source and an evacuation cylinder, respectively.

As will be apparent from the foregoing illustration, glassy carbon as the needle-shaped cathode of the field emission cathode has the following excellent characteristic properties:

(1) The current damping after flashing in ultra high vacuum is only 10% in case of the cathode of the present invention, whereas this damping is 90% in case of the conventional tungsten cathode. Accordingly, the cathode of the present invention can be used even just after flashing and it can be used stably for a long time without performing flashing.

(2) When the cathode of the present invention is used in the heated state, field emission can be accomplished stably even under such a high vacuum pressure as $10^{-7}$ Torr. This excellent stability cannot be obtained at all in any of other materials.

(3) When an electric field is applied so as to take out a certain current density, the aperture angle of emitted electrons is smaller than in any of other crystalline substances. Accordingly, the amounts of outgases discharged from the anode can be maintained at minimum levels (if the cathode surface is not treated with other substance by vacuum deposition or the like).

(4) Even when one field emission cathode is employed, a large current of about 1 mA can easily be taken out even if ultra high vacuum is not especially adopted. Such large current cannot be obtained in any of other cathode materials such as tungsten and carbon fiber.

What is claimed is:

1. A field emission cathode comprising a cathode base and a needle-shaped cathode composed of glassy carbon, said needle-shaped cathode having an equivalent radius of 1000 to 3000 Å.

2. A field emission cathode as set forth in claim 1 wherein the cathode base is composed of a substance elected from the group consisting of conductive carbon, tungsten, tantalum, rhenium, titanium and zirconium.

3. A field emission cathode as set forth in claim 1 wherein the cathode base is composed of conductive carbon having a specific resistance of the order of about $10^{-3}$ Ω-cm.

4. A field emission cathode as set forth in claim 1 wherein the cathode base is composed of one member selected from strip-like carbon and rod-like carbon.

5. A field emission cathode as set forth in claim 1 wherein the needle-shaped cathode is composed of glassy carbon obtained by curing at least one thermosetting resin selected from the group consisting of furan resins, phenolic resins, pyrrole resins and vinyl resins derived from divinyl benzene and carbonizing the cured resin in an atmosphere selected from a vacuum atmosphere and an inert gas atmosphere.

6. A method for the preparation of a needle-shaped cathode of a field emission cathode comprising the steps of shaping a glassy carbon raw material into a form of a needle-shaped cathode, curing the shaped glassy carbon raw material, hardening and carbonizing the cured and shaped glassy carbon raw material at a high temperature in an atmosphere selected from a vacuum atmosphere and an inert gas atmosphere to thereby convert the glassy carbon raw material to glassy carbon, and etching the tip of the resulting glassy carbon needle-shaped cathode to form an equivalent radius of 1000 to 3000 Å.

7. A method for the preparation of a needle-shaped cathode according to claim 6 wherein the glassy carbon raw material is a semi-polymer of at least one thermosetting resin selected from the group consisting of furan resins, phenolic resins, pyrrole resins and vinyl resins derived from divinyl benzene.

8. A method for the preparation of a needle-shaped cathode of a field emission cathode comprising the steps of shaping a glassy carbon raw material into a form of a needle-shaped cathode, curing the shaped glassy carbon raw material, hardening and carbonizing the cured and shaped glassy carbon raw material at a high temperature in an atmosphere selected from a vacuum atmosphere and an inert gas atmosphere to thereby convert the glassy carbon raw material to glassy carbon, and etching the tip of the resulting glassy carbon needle-shaped cathode, wherein calcination is conducted by elevating the temperature at a rate of about 1 to about 6° C./min to about 350° C. and further elevating the temperature at a rate of about 30° C. to about 1500° C.

9. A method for the preparation of a needle-shaped cathode according to claim 8 wherein calcination is conducted in a vacuum furnace.

10. A method for the preparation of a needle-shaped cathode according to claim 8 wherein calcination is conducted by applying electricity to the cathode to thereby heat it.

11. A method for the preparation of a needle-shaped cathode according to claim 6 wherein etching is conducted according to the flame etching method.

12. A method for the preparation of a field emission cathode comprising the steps of shaping on a cathode base a glassy carbon raw material into a form of a needle-shpaed cathode, curing the shaped glassy carbon raw material, calcining and carbonizing the cured and shaped glassy carbon raw material at a high temperature in an atmosphere selected from a vacuum atmosphere and an inert gas atmosphere to thereby convert the glassy carbon raw material to glassy carbon, and etching the tip of the resulting glassy carbon needle-shaped cathode to form an equivalent radius of 1000 to 3000 Å.

13. A method for the preparation of a field emission cathode according to claim 12 wherein the glassy carbon raw material is a semi-polymer of at least one thermosetting resin selected from the group consisting of furan resins, phenolic resins, pyrrole resins and vinyl resins derived from divinyl benzene.

14. A method for the preparation of a field emission cathode according to claim 12 wherein calcination is conducted in a vacuum furnace.

15. A method for the preparation of a field emission cathode according to claim 12 wherein calcination is conducted by applying electricity to the cathode to thereby heat it.

16. A method for the preparation of a field emission cathode according to claim 12 wherein etching is conducted according to the flame etching method.

17. A method for the preparation of a needle-shaped cathode according to claim 8, wherein the glassy carbon raw material is a semi-polymer of at least one thermosetting resin selected from the group consisting of furan resins, phenolic resins, pyrrole resins and vinyl resins derived from divinyl benzene.

18. A method for the preparation of a needle-shaped cathode according to claim 8, wherein etching is conducted according to the flame etching method.

19. A field emission cathode device comprising two cathode supporting members disposed in a vacuum instrument having an anode slit, a cathode base supported by said supporting members, a needle-shaped cathode mounted on said cathode base, said needle-shaped cathode being composed of glassy carbon, and said needle-shaped cathode having an equivalent radius of 1000 to 3000 Å, electrodes connected to said supporting members, respectively, and a power source mounted to apply electricity to the cathode base through said electrodes to heat the cathode base at a temperature of about 700 to about 2000° C.

20. A field emission cathode device according to claim 19, wherein means are provided for establishing a pressure of $10^{-7}$ torr.

21. In a field emission cathode comprising a cathode base and a needle-shaped cathode having an equivalent radius of 1000 to 3000 Å, the improvement comprising said needle-shaped cathode being composed of glassy carbon, wherein said field emission cathode has the property that field emission of electrons is stably maintained at a pressure higher than $10^{-9}$ torr.

22. A field emission cathode according to claim 21, wherein said field emission cathode maintains stable field emission of electrons at a pressure of the order of $10^{-7}$ torr.

23. A method for the preparation of a field emission cathode comprising the steps of shaping on a cathode base a glassy carbon raw material into a form of a needle-shaped cathode, curing the shaped glassy carbon raw material, calcining and carbonizing the cured and shaped glassy carbon raw material at a high temperature in an atmosphere selected from a vacuum atmosphere and an inert gas atmosphere to thereby convert the glassy carbon raw material to glassy carbon, and etching the tip of the resulting glassy carbon needle-shaped cathode, wherein calcination is conducted by elevating the temperature at a rate of about 1 to about 6° C./min to about 350° C. and further elevating the temperature at a rate of about 10 to about 30° C. to about 1500° C.

24. A method for the preparation of a field emission cathode according to claim 23, wherein the glassy carbon raw material is a semi-polymer of at least one thermosetting resin selected from the group consisting of furan resins, phenolic resins, pyrrole resins and vinyl resins derived from divinyl benzene.

25. A method for the preparation of a field emission cathode according to claim 23, wherein calcination is conducted in a vacuum furnace.

26. A method for the preparation of a field emission cathode according to claim 23, wherein calcination is conducted by applying electricity to the cathode to thereby heat it.

27. A method for the preparation of a field emission cathode according to claim 23, wherein etching is conducted according to the flame etching method.

28. A field emission cathode as set forth in claim 23, wherein the cathode base is composed of a substance elected from the group consisting of conductive carbon, tungsten, tantalum, rhenium, titanium and zirconium.

29. A field emission cathode as set forth in claim 23, wherein the cathode base is composed of conductive carbon having a specific resistance of the order of about $10^{-3}$ Ω-cm.

30. A field emission cathode as set forth in claim 23, wherein the cathode base is composed of one member selected from strip-like carbon and rod-like carbon.

* * * * *

UNITED STATES PATENT AND TRADEMARK OFFICE

CERTIFICATE OF CORRECTION

PATENT NO. : 4,143,292

DATED : March 6, 1979

INVENTOR(S) : Shigeyuki Hosoki and Hiroshi Okano

Figure 7A:
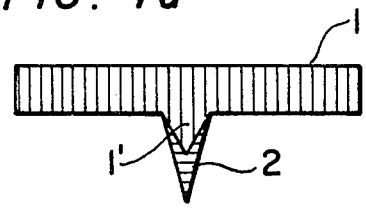

It is certified that error appears in the above-identified patent and that said Letters Patent are hereby corrected as shown below:

In The Drawings:

Figure 7a - Reference numeral "1" should be -- 9 --,
- Reference numeral "1'" should be -- 9' --,
- Reference numeral "2" should be -- 8 --.

Figure 7B:
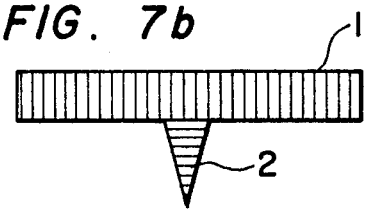

Figure 7b - Reference numeral "1" should be -- 9 --,
- Reference numeral "2" should be -- 8 --.

Figure 7C:
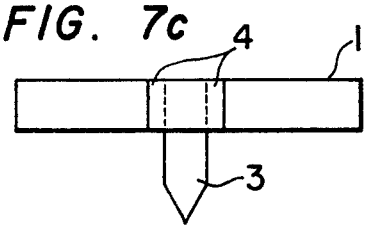

Figure 7c - Reference numeral "1" should be -- 9 --,
- Reference numeral "3" should be -- 8 --,
- Reference numeral "4" should be -- 18 --.

Figure 8 - Reference numeral "1" should be -- 9 --,
- Reference numeral "2" should be -- 8 --,
- Reference numeral "5" should be -- 10 --,
- Reference numeral "6" should be -- 14 --,
- Reference numeral "7" should be -- 11 --,
- Reference numeral "8" should be -- 12 --.

Signed and Sealed this

*Twenty-eighth* Day of *August 1979*

[SEAL]

*Attest:*

*Attesting Officer*

LUTRELLE F. PARKER

*Acting Commissioner of Patents and Trademarks*